US006534564B2

(12) United States Patent
Hanejko et al.

(10) Patent No.: US 6,534,564 B2
(45) Date of Patent: Mar. 18, 2003

(54) METHOD OF MAKING METAL-BASED COMPACTED COMPONENTS AND METAL-BASED POWDER COMPOSITIONS SUITABLE FOR COLD COMPACTION

(75) Inventors: Francis G. Hanejko, Marlton, NJ (US); Sydney Luk, Lafayette Hill, PA (US); Kalathur S. V. L. Narasimhan, Moorestown, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 0 days.

(21) Appl. No.: 09/865,082

(22) Filed: May 24, 2001

(65) Prior Publication Data

US 2002/0037948 A1 Mar. 28, 2002

Related U.S. Application Data

(60) Provisional application No. 60/208,173, filed on May 31, 2000.

(51) Int. Cl.[7] ..... B22C 1/00
(52) U.S. Cl. ..... 523/139
(58) Field of Search ..... 523/139

(56) References Cited

U.S. PATENT DOCUMENTS

| | | | | |
|---|---|---|---|---|
| 4,601,765 A | | 7/1986 | Soileau et al. | 148/104 |
| 4,834,800 A | | 5/1989 | Semel | 106/403 |
| 5,062,896 A | * | 11/1991 | Huang | 106/287.19 |
| 5,063,011 A | | 11/1991 | Rutz et al. | 264/126 |
| 5,108,493 A | | 4/1992 | Causton | 75/255 |
| 5,198,137 A | | 3/1993 | Rutz et al. | 252/62.54 |
| 5,225,459 A | | 7/1993 | Oliver et al. | 523/220 |
| 5,236,630 A | * | 8/1993 | Arima | 252/512 |
| 5,268,140 A | | 12/1993 | Rutz et al. | 419/54 |
| 5,306,524 A | | 4/1994 | Rutz et al. | 427/216 |
| 5,330,792 A | | 7/1994 | Johnson et al. | 427/217 |
| 5,368,630 A | | 11/1994 | Luk | 75/252 |
| 5,492,980 A | * | 2/1996 | Moriwaki | 525/429 |
| 5,498,276 A | | 3/1996 | Luk | 75/252 |
| 5,543,174 A | | 8/1996 | Rutz | 427/213 |
| 5,744,433 A | | 4/1998 | Storstrom et al. | 508/454 |
| 5,767,426 A | | 6/1998 | Oliver et al. | 75/246 |
| 6,039,784 A | | 3/2000 | Luk | 75/231 |
| 6,136,379 A | * | 10/2000 | Scarpa | 427/426 |
| 6,203,589 B1 | * | 3/2001 | Ohmori | 51/298 |

OTHER PUBLICATIONS

U.S. patent application Ser. No. 09/434,000, filed Nov. 4, 1999.

Gachter R. et al. *"Stabilizers, Processing Aids, Plastcizers, Fillers, Reinforcements, Colorants for Thermoplastics"*, Plastics Additives Notebook, pp 270–281 & 288–295.

* cited by examiner

*Primary Examiner*—Edward J. Cain
(74) *Attorney, Agent, or Firm*—Woodcock Washburn LLP

(57) ABSTRACT

A method is provided for compacting metal-based powder compositions containing at least one thermoplastic material at temperatures below the glass transition temperature or melting temperature of the thermoplastic material to form a metal-based component. Preferably, compaction is carried out at temperatures ranging from ambient to about 55° C. The method of the present invention is particularly useful for making magnetic core components. The present invention also provides metal-based powder compositions useful for cold compaction. The metal based powder compositions contain metal-based particles containing no iron phosphate layer; a thermoplastic material selected from polyetherimides, polyphenylene ethers, polyethersulfones, polycarbonates, polyethylene glycol, polyvinyl acetate, polyvinyl alcohol or combinations thereof, and an oligomer of a polyamide.

20 Claims, No Drawings

METHOD OF MAKING METAL-BASED COMPACTED COMPONENTS AND METAL-BASED POWDER COMPOSITIONS SUITABLE FOR COLD COMPACTION

This application claims the benefit of U.S. Provisional Application No. 60/208,173 filed May 31, 2000.

FIELD OF THE INVENTION

The present invention relates to a method for making metal-based compacted components and metal-based powder compositions suitable for cold compaction. More particularly, the present invention is directed to a method of compacting certain metal-based powder compositions at cold compaction temperatures to form metal-based components. The method is particularly useful for making magnetic core components.

BACKGROUND OF THE INVENTION

Iron-based particles have long been used in the manufacture of metal-based components by powder metallurgical methods. The iron-based particles are first molded in a die under pressure in order to produce the desired shape. After the molding step, the metal-based component (e.g., a "green" part) usually undergoes a sintering step (i.e., temperatures greater than about 490° C.) to impart the necessary strength to the component.

The powder metallurgy art generally uses four standard temperature regimes for compacting a metal powder to form a metal component. These include chill-pressing (pressing below ambient temperatures), cold-pressing (pressing at ambient temperatures), hot-pressing (pressing at temperatures above those at which the metal powder is capable of retaining work-hardening), and warm-pressing (pressing at temperatures between cold-pressing and hot-pressing).

Iron-based powder compositions that are generally warm pressed include iron particles that are either admixed or coated with a thermoplastic material. Examples of such iron-based powder compositions are disclosed in for example U.S. Pat. Nos. 5,063,011, 5,198,137, 5,225,459, 5,268,140, 5,767,426, and 6,039,784. These types of iron-based powder compositions have typically been compressed at die temperatures above the glass transition temperature of the thermoplastic material. For example, the aforementioned U.S. Pat. No. 5,268,140 discloses a method of compacting iron-based particles coated or admixed with a thermoplastic material that includes compacting the powder in a die at a temperature above the glass transition temperature of the thermoplastic material and separately heating the component to a temperature that is at least as high as the compaction temperature. Such compaction temperatures are used because it was believed that compaction temperatures below the glass transition temperature of the thermoplastic material would yield components having poor strength and density properties.

Moreover, as iron-based powders admixed or coated with a thermoplastic material are often used to form magnetic core components, it was believed that compacting such powders below the glass transition powder of the temperature would yield components having poor magnetic performance. Important magnetic characteristics of a core component are its magnetic permeability and core loss characteristics. The magnetic permeability of a material is an indication of its ability to become magnetized, or its ability to carry a magnetic flux. Permeability is defined as the ratio of the induced magnetic flux to the magnetizing force or field intensity. Core loss, which is an energy loss, occurs when a magnetic material is exposed to a rapidly varying field. The core losses are commonly divided into two categories: hysteresis and eddy-current losses. The hysteresis loss is brought about by the necessary expenditure of energy to overcome the retained magnetic forces within the metal-based core component. The eddy-current loss is brought about by the production of electric currents in the metal based core component due to the changing flux caused by alternating current (AC) conditions.

Despite the advantages of warm compaction methods as described above, heating the die to above the glass transition temperature of the thermoplastic material can be time consuming and can cause excessive wear on the die. Moreover, often it is desired to heat the iron-based powder prior to introduction in the die. Heating the iron-based powder can also be time consuming as well. Thus, it is desirable to provide a method for compacting iron-based powders that does require the die to be heated or the iron-based powder to achieve acceptable properties such as strength, density, and magnetic performance.

U.S. Pat. No. 5,754,936 to Jansson ("Jansson"), discloses a process where iron particles are first treated with phosphoric acid to form an iron phosphate layer and the resulting phosphate coated particles are admixed with a thermoplastic resin and lubricant, and compacted at a temperature below the glass transition temperature of the thermoplastic resin. The compacted component is then heated to the curing temperature of the thermoplastic resin. Although the compaction in Jansson can be carried out at ambient temperature, Jansson requires coating the iron first with phosphoric acid to form an iron phosphate layer. This extra processing step can be time consuming as the solvent (e.g., water) carrying the phosphoric acid must be removed and the particles must then be heat treated to form the iron phosphate layer.

Thus, it is desired to provide an efficient method of making metal-based components that does not require heating of the die and/or the metal-based powder for compaction, and provides metal-based components having acceptable properties.

SUMMARY OF THE INVENTION

The present invention provides a method of making a metal-based component that includes providing a metal-based powder composition containing metal-based particles having an outer coating of at least one thermoplastic material, the thermoplastic material constituting from about 0.001% to about 15% by weight of the metal-based particles as coated, wherein the metal-based particles are free of an iron phosphate layer; and compacting the composition in a die at a temperature below 55° C. to form a component.

In another embodiment, the present invention provides a method of making a metal-based component that includes providing a metal-based/thermoplastic powder composition containing metal-based particles that are free of an iron phosphate layer and that are admixed with a thermoplastic material in particulate form, the thermoplastic material constituting from about 0.001% to about 15% by weight of the composition. The metal-based/thermoplastic powder composition is then compacted in a die at a temperature below about 55° C.

The metal-based components thus formed surprisingly have comparable properties of strength, density, and magnetic performance to metal-based components compacted at temperatures above the glass transition temperature of the thermoplastic material. Thus, the present invention is also useful for making magnetic components by providing a metal-based composition containing metal-based particles and a thermoplastic material and compacting the composition in a die at a temperature below about 55° C.

In another embodiment, the present invention provides a metal-based powder composition suitable for cold compaction containing from about 80.0 weight percent to about 99.8 weight percent of a metal-based powder, containing metal-based particles, where the metal-based particles are free of an iron phosphate layer; from about 0.001 weight percent to about 15 weight percent, of a thermoplastic material selected from polyetherimides, polyphenylene ethers, polyethersulfones, polycarbonates, polyethylene glycol, polyvinyl acetate, polyvinyl alcohol or combinations thereof; and from about 0.1 weight percent to about 2.0 weight percent of an oligomer of a polyamide.

DETAILED DESCRIPTION

The present invention provides a method for compacting metal-based powder compositions at cold compacting temperatures to form metal-based components, thus eliminating the need to use a heated die to produce the compacted components. The present invention also provides certain metal-based powder compositions suitable for cold compaction. By "cold compaction" as used herein, it is meant compacting a metal-based powder composition, where the die or metal-based powder composition is at a temperature ranging preferably from ambient temperature to about 65° C., more preferably from about ambient temperature to about 55° C., and most preferably from ambient temperature to 40° C. during compaction. By "ambient temperature" it is meant the temperature of a powder composition or the die during compaction where no external heat is added to the die or powder (however, heat can be acquired by the powder composition or die through the environment and/or heat dissipated during processing, e.g., through the energy exerted during compaction).

The method of the present invention includes providing a metal-based powder composition containing metal-based particles and at least one thermoplastic material, where the thermoplastic material constitutes from about 0.001 weight percent to about 15 weight percent of the metal-based powder composition; and compacting the composition in a die at a temperature below 50° C. to form a metal-based component. The metal-based component may then optionally be heat treated as described hereinafter to improve the properties of the metal-based component.

The metal-based particles useful in the present invention comprise metal powders of the kind generally used in the powder metallurgy industry, such as iron-based powders and nickel-based powders. The metal-based particles constitute a major portion of the metal-based powder composition, and generally constitute at least about 80 weight percent, preferably at least about 85 weight percent, and more preferably at least about 90 weight percent based on the total weight of the metal-based powder composition.

Examples of "iron-based" powders, as that term is used herein, are powders of substantially pure iron, powders of iron pre-alloyed with other elements (for example, steel-producing elements) that enhance the strength, hardenability, electromagnetic properties, or other desirable properties of the final product, and powders of iron to which such other elements have been diffusion bonded.

Substantially pure iron powders that can be used in the invention are powders of iron containing not more than about 1.0% by weight, preferably no more than about 0.5% by weight, of normal impurities. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85–3.00 g/cm3, typically 2.94 g/cm3. Other iron powders that can be used in the invention are typical sponge iron powders, such as Hoeganaes' ANCOR MH-100 powder.

The iron-based powder can incorporate one or more alloying elements that enhance the mechanical or other properties of the final metal part. Such iron-based powders can be powders of iron, preferably substantially pure iron, that has been pre-alloyed with one or more such elements. The pre-alloyed powders can be prepared by making a melt of iron and the desired alloying elements, and then atomizing the melt, whereby the atomized droplets form the powder upon solidification.

Examples of alloying elements that can be pre-alloyed with the iron powder include, but are not limited to, molybdenum, manganese, magnesium, chromium, silicon, copper, nickel, gold, vanadium, columbium (niobium), graphite, phosphorus, aluminum, and combinations thereof. Preferred alloying elements are molybdenum, phosphorus, nickel, silicon or combinations thereof. The amount of the alloying element or elements incorporated depends upon the properties desired in the final metal part. Pre-alloyed iron powders that incorporate such alloying elements are available from Hoeganaes Corp. as part of its ANCORSTEEL line of powders.

A further example of iron-based powders are diffusion-bonded iron-based powders which are particles of substantially pure iron that have a layer or coating of one or more other metals, such as steel-producing elements, diffused into their outer surfaces. Such commercially available powders include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper.

A preferred iron-based powder is of iron pre-alloyed with molybdenum (Mo). The powder is produced by atomizing a melt of substantially pure iron containing from about 0.5 to about 2.5 weight percent Mo. An example of such a powder is Hoeganaes' ANCORSTEEL 85HP steel powder, which contains about 0.85 weight percent Mo, less than about 0.4 weight percent, in total, of such other materials as manganese, chromium, silicon, copper, nickel, molybdenum or aluminum, and less than about 0.02 weight percent carbon. Another example of such a powder is Hoeganaes' ANCORSTEEL 4600V steel powder, which contains about 0.5–0.6 weight percent molybdenum, about 1.5–2.0 weight percent nickel, and about 0.1–0.25 weight percent manganese, and less than about 0.02 weight percent carbon.

Another pre-alloyed iron-based powder that can be used in the invention is disclosed in U.S. Pat. No. 5,108,493, entitled "Steel Powder Admixture Having Distinct Pre-alloyed Powder of Iron Alloys," which is herein incorporated by reference in its entirety. This steel powder composition is an admixture of two different pre-alloyed iron-based powders, one being a pre-alloy of iron with 0.5–2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition. An example of such a powder is commercially available as Hoeganaes' ANCORSTEEL 41 AB steel powder, which contains about 0.85 weight percent molybdenum, about 1 weight percent nickel, about 0.9 weight percent manganese, about 0.75 weight percent chromium, and about 0.5 weight percent carbon.

Other iron-based powders that are useful in the practice of the invention are ferromagnetic powders. An example is a powder of iron pre-alloyed with small amounts of phosphorus.

The iron-based powders that are useful in the practice of the invention also include stainless steel powders. These stainless steel powders are commercially available in various grades in the Hoeganaes ANCOR® series, such as the ANCOR® 303L, 304L, 316L, 410L, 430L, 434L, and 409Cb powders.

The iron-based powder have a distribution of particle sizes. Typically, these powders are such that at least about 90% by weight of the powder sample can pass through a No. 45 sieve (U.S. series), and more preferably at least about 90% by weight of the powder sample can pass through a No. 60 sieve. These powders typically have at least about 50% by weight of the powder passing through a No. 70 sieve and retained above or larger than a No. 400 sieve, more preferably at least about 50% by weight of the powder passing through a No. 70 sieve and retained above or larger than a No. 325 sieve. Also, these powders typically have at least about 5 weight percent, more commonly at least about 10 weight percent, and generally at least about 15 weight percent of the particles passing through a No. 325 sieve. As such, these powders can have a weight average particle size as small as one micron or below, or up to about 850–1,000 microns, but generally the particles will have a weight average particle size in the range of about 10–500 microns. Preferred are iron-alloy particles or substantially pure iron particles having a maximum weight average particle size up to about 350 microns; more preferably the particles will have a weight average particle size in the range of about 25–150 microns, and most preferably 80–150 microns. Reference is made to MPIF Standard 05 for sieve analysis.

The metal powder used in the present invention can also include nickel-based powders. Examples of "nickel-based" powders, as that term is used herein, are powders of substantially pure nickel, and powders of nickel pre-alloyed with other elements that enhance the strength, hardenability, electromagnetic properties, or other desirable properties of the final product. The nickel-based powders can be admixed with any of the alloying powders mentioned previously with respect to the iron-based powders. Examples of nickel-based powders include those commercially available as the Hoeganaes ANCORSPRAY® powders such as the N-70/30 Cu, N-80/20, and N-20 powders.

The thermoplastic material useful in the metal-based powder composition is any polymeric material having thermoplastic properties that, when admixed with or coated onto the metal-based particles, provides green strength to a cold compacted metal component. The thermoplastic material preferably associates with the metal-based particles either prior to or during compaction. By "associate" as used herein, it is meant any manner in which the thermoplastic material is adhered to the surfaces of the metal-based particles. For example, the thermoplastic material may be bonded to or coated onto the metal-based powders through the use of a solvent. Preferred thermoplastic materials are those that have a weight average molecular weight in the range of about 10,000 to 50,000. More preferred are thermoplastic polymers of such a molecular weight range that have a glass transition temperature in the range of about 175–500° F. (about 80–260° C.) or a melting temperature that is at least greater than about 90° C. Examples of the thermoplastic material are polycarbonates, polyphenylene ethers, polyetherimides, polyethersulfones, polyamides, polymers of ethylene bisstearamides, or combinations thereof.

Suitable polycarbonates that can be utilized as a thermoplastic in the present invention are bisphenol-A-polycarbonates, also known as poly(bisphenol-A-carbonate). These polycarbonates have a specific gravity range of about 1.2 to 1.6. A specific example is poly (oxycarbonyloxy-1,4-phenylene-(1-methylethlidene)-1,4-phenylene) having an empirical formula of $(C_{16}H_{14}O_3)_n$ where n is an integer of about 30–60. Commercially available polycarbonates are the LEXAN resins from General Electric Company. The most preferred LEXAN resins are the LEXAN 121 and 141 grades.

A suitable polyphenylene ether thermoplastic is poly(2, 6-dimethyl-1,4-phenylene oxide) which has an empirical formula of $(C_8H_8O)_n$ where n is an integer of about 30–100. The polyphenylene ether homopolymer can be admixed with an alloying/blending resin such as a high impact polystyrene, such as poly(butadiene-styrene); and a polyamide, such as Nylon 66 either as polycaprolactam or poly(hexamethylenediamine-adipate). These thermoplastic materials have a specific gravity in the range of about 1.0 to 1.4. A commercially available polyphenylene is sold as NORYL resin by the General Electric Company. The most preferred NORYL resins are the NORYL 844, 888, and 1222 grades.

A suitable polyetherimide thermoplastic is poly[2,2'-bis (3,4-dicarboxyphenoxy) phenylpropane)-2-phenylene bismide] which has an empirical formula of $(C_{37}H_{24}O_6N_2)_n$ where n is an integer of about 15–27. The polyetherimide thermoplastics have a specific gravity in the range of about 1.2 to 1.6. A commercially available polyetherimide is sold as ULTEM resin by the General Electric Company. The most preferred ULTEM resin is the ULTEM 1000 grade.

A suitable polyethersulfone thermoplastic has the general empirical formula of $(C_{12}H_{16}SO_3)_n$ where n is an integer of about 50–200. An example of a suitable polyethersulfone which is commercially available is sold as VICTREX PES by ICI, Inc. The most preferred of these resins is the VICTREX PES 5200 grade.

Suitable polyamides are those described in for example U.S. Pat. No. , 5,744,433 ("433 patent"), the disclosure of which is hereby incorporated by reference in its entirety. The polyamides described in the '433 patent include oligomers that include lactams containing the repeating unit:

$$[NH—(CH_2)_m—CO]_n —$$

where m is in the range of from about 5 to about 11, and n is in the range of from about 5 to about 50.

The polyamides in the '433 patent also include oligomers formed from diamines and dicarboxylic acids to contain the following repeating unit:

$$—[NH—(CH_2)_m—NCO(CH_2)_n—CO]_x—$$

where m and n are in the range of from about 4 to about 12, where the sum of m and n is greater than about 12, and where x ranges from about 2 to about 25.

These oligomers preferably have a weight average molecular weight of less than about 30,000 and a melting point ranging beginning at about 100° C. to about 220° C. Moreover, one skilled in the art will recognize that the aforementioned oligomers may be terminated with various functional groups, such as those terminal groups described in the '433 patent.

Specific examples of the oligomers of polyamides useful in the present invention include Orgasol™ 3501, Orgasol™ 2001, and Orgasol™ 2002 supplied by Elf Atochem of France. A benefit to using these oligomers is that they can also act as an internal die lubricant, thus eliminating the need for other lubricants.

A suitable ethylene bis-stearamide is a polymer composition containing ethylene bis-stearamide and zinc stearate. A preferred ethylene bis-stearamide is Kenolube™ lubricant supplied by Hoganas Corporation, located in Hoganas, Sweden. An advantage to using this thermoplastic material is that it also can act as an internal lubricant.

Other thermoplastic materials useful in the metal-based powder composition include for example homopolymers or copolymers of polyethylene glycol, polypropylene glycol, polyvinyl acetate, polyvinyl alcohol, alkyl acrylate, alkyl methacrylate, alkyd resins, cellulosic ester or ether resins, polyurethanes, polyesters, polyolefins having a weight average molecular weight below 3000 such as polyethylenes, or combinations thereof.

The amount of the thermoplastic material to be associated with the metal-based particles is generally about 0.001–15% by weight of the total weight of the metal-based particles and thermoplastic material. Preferably, the thermoplastic material is at least about 0.2% by weight, up to about 5% by weight, of this combination. More preferably the thermoplastic material is about 0.4–2% by weight, and most preferably about 0.6–1.0% by weight, of the total weight of the metal-based particles and thermoplastic material.

The thermoplastic material can be admixed with the metal-based powder particles by any method known to those in the art. For example, the thermoplastic material may be uniformly blended with the metal-based particles without the use of solvent. It is preferred for the polyamide oligomers and polymers containing ethylene bisstearamide to be blended in this fashion. Also, for example, the thermoplastic material may be coated onto the metal-based particles by means of a fluidized bed application process such as that described in U.S. Pat. No. 5,198,137 to Rutz et al, which is hereby incorporated in its entirety by reference. This method is particularly when the thermoplastic material is the polyphenylene ethers, polyetherimides, or polyethersulfones. Another method is to bond the polymeric material onto the metal-based particles as described in U.S. Pat. No. 5,225,459 to Oliver et al., which is hereby incorporated by reference in its entirety. This bonding method is preferably used when the thermoplastic material is polyphenylene ethers, polyetherimides, or polyethersulfones.

In a preferred coating method, the coating is applied in a fluidized bed process, preferably with use of a Wurster coater such as manufactured by Glatt, Inc. During the Wurster coating process, the metal-based particles are fluidized in air. The thermoplastic material is dissolved in an appropriate organic solvent and the resulting solution is sprayed through an atomizing nozzle into the inner portion of the Wurster coater, where the solution contacts the fluidized bed of iron particles. Any organic solvent for the thermoplastic material can be used, but preferred solvents are methylene chloride, 1,1,2 trichloroethane, and acetone. Blends of these solvents can also be used. The concentration of thermoplastic material in the coating solution is preferably at least 3% and more preferably about 5–10% by weight. The use of a peristaltic pump to transport the thermoplastic solution to the nozzle is preferred. The fluidized metal-based particles are preferably heated to a temperature of at least about 25° C., more preferably at least about 30° C., but below the solvent boiling point, prior to the addition of the solution of thermoplastic material. The metal-based particles are wetted by the droplets of dissolved thermoplastic, and the wetted particles are then transferred into an expansion chamber in which the solvent is removed from the particles by evaporation, leaving a substantially uniform coating of thermoplastic material around the metal-based, core particles.

The amount of thermoplastic material coated onto the metal-based particles can be monitored by various means. One method of monitoring the thermoplastic coating process is to operate the coater in a batch-wise fashion and administer the amount of thermoplastic necessary for the desired coating percentage at a constant rate during the batch cycle, with a known amount of thermoplastic in the solution being used. Another method is to constantly sample the coated particles within the fluidized bed for carbon content and correlate this to a thermoplastic coating content.

This process provides metal-based powders with a substantially uniform circumferential coating of thermoplastic material. The final physical characteristics of the coated particles can be varied by manipulation of different operating parameters during the coating process.

A preferred thermoplastic-coated iron particle is characterized by having an apparent density from about 2.4 g/cm$^3$ to about 2.7 g/cm$^3$ and a thermoplastic coating that constitutes about 0.25–2.0% by weight of the particles as coated. It has been found that components made from particles within these limits exhibit superior magnetic properties.

When the thermoplastic material is to be bonded to or blended with the metal-based powder particles, the thermoplastic material is generally provided in the form of particles, which will preferably be spherical but can be, for example, lenticular or flake-shaped. The particles are preferably fine enough to pass through a No. 60 sieve, U.S. Series (about 250 microns or less), more preferably through a No. 100 sieve (about 150 microns or less) and most preferably through a No. 140 sieve (about 105 microns or less). However, the absolute size of the polymer particles is less important than their size in relation to the size of the metal-based particles; preferably the polymer particles will be finer than the metal-based particles.

In a preferred bonding process, the metal-based particles and the particles of the thermoplastic material are admixed together, preferably in dry form, by conventional mixing techniques to form a substantially homogeneous particle blend. The dry admixture is then contacted with sufficient solvent to wet the particles, and more particularly to soften and/or partially dissolve the surfaces of the polymeric particles, causing those particles to become tacky and to adhere or bond to the surfaces of the metal-based particles. Preferably the solvent is applied to the dry admixture by spraying fine droplets of the solvent during mixing of the dry blend. Most preferably mixing is continued throughout the solvent application to ensure wetting of the polymer materials and homogeneity of the final mixture. The solvent is thereafter removed by evaporation, optionally with the aid of heating, forced ventilation, or vacuum. Mixing can be continued during the solvent removal step, which will itself aid evaporation of the solvent. The initial dry blending of the particles as well as the application and removal of the solvent can be effected in conventional mixing equipment outfitted with suitable solvent application and recovery means. The conical screw mixers available from the Nauta Company can be used for this purpose.

In the bonding process, any organic solvent for the thermoplastic material can be used. Preferred are methylene chloride, 1,1,2-trichloroethane, and acetone. Blends of these solvents can also be used. A preferred combination for use in this invention uses a polyetherimide thermoplastic as the thermoplastic material and methylene chloride as the solvent. The amount of solvent applied to the dry admixture will be about 1–25 weight parts solvent per 100 weight parts of iron-based powder. Generally, however, it is more convenient to calculate the amount of solvent based on the amount of thermoplastic material present. In these terms, about 1.5–50 weight parts, preferably about 3–20 weight parts, more preferably about 5–10 weight parts of solvent per unit weight part of polymer, will sufficiently wet the admixture.

If desired, the metal-based particles can first be coated with (i.e., prior to combination with the thermoplastic material) an insulative inorganic material to provide an inner coating. This inner coating is preferably no greater than about 0.2% by total weight of the total weight of the particles (including all coatings). Such inner coatings include iron phosphate as discussed in U.S. Pat. No. 5,063,011 to Rutz et al, and alkaline metal silicates, such as disclosed in U.S. Pat. No. 4,601,765. The disclosures of both documents are hereby incorporated by reference in their entireties. Preferably however, the metal-based particles contain no insulative inorganic inner coating. For example, the metal-based particles are preferably free of an iron phosphate layer.

The metallurgical powder compositions of the present invention may also include any special-purpose additive commonly used with metallurgical composition such as lubricants, machining agents, and plasticizers.

Lubricants are used for example to reduce the ejection force required to remove a compacted part from the die cavity. Examples of typical powder metallurgy lubricants include the stearates, such as zinc stearate, lithium stearate, manganese stearate, or calcium stearate; synthetic waxes, such as ethylene bisstearamide or polyolefins; or combinations thereof. The lubricant may also be a polyamide lubricant, such as PROMOLD-450, disclosed in U.S. Pat. No. 5,368,630, particulate ethers disclosed in U.S. Pat. Nos. 5,498,276, and 6,039,784 to Luk, or a metal salt of a fatty acid disclosed in U.S. Pat. No. 5,330,792 to Johnson et al., the disclosures of which are hereby incorporated by reference in their entireties. The lubricant may also be an oligomer polyamide such as Orgasol™ 3501 Orgasol™ 2001, and Orgasol™ 2002 previously described herein. The lubricant may also be a combination of any of the aforementioned lubricants described above.

Preferred lubricants are ethylene bisstearamide, zinc stearate, Kenolube™ (supplied by Hoganas Corporation, located in Hoganas, Sweden), Orgasol™ oligomers, Ferrolube™ (supplied by Blanchford), and polyethylene wax. In a preferred embodiment, the lubricant also acts as a thermoplastic material to enhance green strength such as the Orgasol™ oligomers and Kenolube.™.

The lubricant is generally added in an amount of up to about 2.0 weight percent, preferably from about 0.1 to about 1.5 weight percent, more preferably from about 0.1 to about 1.0 weight percent, and most preferably from about 0.2 to about 0.75 weight percent, of the metallurgical powder composition.

Other additives may also be present in the metal-based powder composition, such as plasticizers and machining agents. Preferably, these other additives are present in the metallurgical powder composition in an amount of from about 0.05 weight percent to about 5.0 weight percent, and more preferably from about 0.1 weight percent to about 1.5 weight percent based on the total weight of the metallurgical powder composition. Representative plasticizers are generally disclosed by R. Gachter and H. Muller, eds., Plastics Additives Handbook (1987) at, for example, pages 270–281 and 288–295. These include alkyl, alkenyl, or aryl esters wherein the alkyl, alkenyl, and aryl moieties have from about 1 to about 10 carbon atoms, from about 1 to about 10 carbon atoms, from about 6 to about 30 carbon atoms, respectively, phthalic acid, phosphoric acid, and dibasic acid. Preferred esters are alkyl esters, such as di-2-ethylhexyl phthalate (DOP), di-iso-nonyl phthalate (DINP), dibutyl phthalate (DBP), trixylenyl phosphate (TCP), and di-2-ethylhexyl adipate (DOA). DBP and DOP are particularly preferred plasticizers. Machining agents, such as molybdenum sulfides, iron sulfides, boron nitride, boric acid, or combinations thereof are typically used to aid in final machining operations.

Metal-base powder compositions that are particularly preferred for cold compaction contain (a) from about 80.0 weight percent to about 99.8 weight percent and more preferably from about 85 weight percent to about 99.3 weight percent of a metal-based particles that are preferably an iron-based particles containing no iron phosphate layer, (b) from about 0.001 weight percent to about 15 weight percent and more preferably from about 0.2 weight percent to about 5 weight percent of a thermoplastic material selected from polyetherimides, polyphenylene ethers, polyethersulfones, polycarbonates, polyethylene glycol, polyvinyl acetate, polyvinyl alcohol or combinations thereof, and (c) from about 0.1 weight percent to about 2.0 weight percent, and more preferably from about 0.3 weight percent to about 1.0 weight percent of an oligomer of a polyamide, where the weight percentages are based on the total weight of the metal-based powder composition.

The preferred metal-based powder compositions may be formed according to any technique previously described herein. For example, the thermoplastic material may be coated onto the metal- based powder, followed by admixing the oligomer into the coated metal-based powder composition. Alternatively, the metal-based powder, the thermoplastic material, and oligomer may be admixed in any fashion with or without solvent.

The metal-based powder composition once formed is compacted by any appropriate molding technique at a temperature below the glass transition temperature or melting temperature of the thermoplastic material, whichever is lower. Preferably the die and powder are maintained at a temperature below 65° C., more preferably from about 55° C. to ambient temperature, and most preferably from ambient temperature to about 40° C. In the most preferred embodiment of the present invention, the die and metal-based powder composition are at ambient temperatures. The powder mixture at the desired temperature (preferably ambient temperature) is charged into the die maintained at the desired temperature, and normal powder metallurgy pressures are applied to press out the desired component. Typical compression molding techniques employ compaction pressures of from about 5 to about 100 tons per square inch (tsi), preferably in the range of about 30 to about 60 tsi. The temperature and pressures during compression molding are generally those that will form a component having the desired green strength for a particular application.

Following compaction, the molded component may optionally be heat treated in order to "cure" the thermoplastic material and provide a component with the desired strength. Heat treating may be carried out for example according to the techniques disclosed in U.S. Pat. No. 5,268,140, the disclosure of which is hereby incorporated by reference in its entirety. The molded component, preferably after removal from the die and preferably after being permitted to cool to ambient temperatures, is then separately heated to a temperature that is less than the melting or degradation temperature of the thermoplastic material. For most thermoplastic materials, the cure temperature will be from about 90° C. to about 480° C., preferably from about 140° C. to about 360° C., and most preferably about 150° C. to about 300° C. The molded component is maintained at the curing temperature for a time sufficient for the component to be thoroughly heated and its internal temperature brought substantially to the curing temperature. Generally heating is required for about 0.5 to 3 hours, depending on the size and initial temperature of the part. The heat treatment can be conducted in air or in an inert atmosphere such as nitrogen.

The heat treatment is a separate heating step from the compaction process. It has been found, however, that the performance of the heat treatment step can occur at any time after compaction. That is, the heat treatment step can proceed immediately after compaction or after the component has cooled. The heat treatment is preferably performed when it is desired to produce a metal component having high green strength.

The metal-based components formed in accordance with the method of the present invention can be used in various applications. For example the metal-based components can be used as weight or non-weight bearing structural components for various types of articles. Additionally, the metal-based components may be used as magnetic core components in AC and/or DC applications. For example, the magnetic core components may be used in electrical/magnetic energy conversion devices such as generators and transformers.

EXAMPLES

Some embodiments of the present invention will now be described in detail in the following Examples. Metal-based powder compositions were prepared and formed into components in accordance with the methods of the present invention. The components formed were evaluated for green and magnetic properties.

Metal-based powder compositions were prepared by coating a thermoplastic material onto Ancorsteel® 1000C iron powder supplied by Hoeganaes Corp., located in Cinnaminson, N.J. The thermoplastic material used was ULTEM® 1000 grade material, a polyetherimide supplied by General Electric Company as previously described herein.

The iron powder was coated with the ULTEM® material by spraying a methylene chloride solution, containing the ULTEM® material, onto the iron powder in a Glatt GPCG-5 Wurster coater, and evaporating the solvent in accordance with the techniques described in U.S. Pat. No. 5,268,140, which is incorporated herein by reference in its entirety. The resulting coated iron powder contained 0.25 weight percent ULTEM® based on the total weight of the coated iron powder composition.

A portion of the coated powder was then admixed with either an Orgasol™ or Kenolube™ material in the amounts shown below in Table 1. The Orgasol™ material is an oligomer of a polyamide supplied by Elf Atochem in France as previously described herein. The Kenolube™ material is a polymer material containing a mixture of ethylene bis-stearamide and zinc stearate from Höganäs AG of Sweden. The powder compositions that were prepared are shown below in Table 1:

TABLE 1

Thermoplastic Coated Powder Compositions

| Composition | Ancorsteel ® 1000C | Ultem ® 1000 (wt %) | Orgasol ™ (wt %) | Kenolube ™ (wt %) |
|---|---|---|---|---|
| A | Balance | 0.25 | 0.0 | 0.0 |
| B | Balance | 0.25 | 0.50 | 0.0 |
| C | Balance | 0.25 | 0.60 | 0.0 |
| D | Balance | 0.25 | 0.0 | 0.50 |

Powder Compositions were also prepared by admixing Ancorsteel® 1000C with either the Orgasol™ or Kenolube™ materials. These powder compositions are shown below in Table 2.

TABLE 2

Uncoated Powder Compositions containing a Thermoplastic Material

| Composition | Ancorsteel ® 1000C | Orgasol ™ (wt %) | Kenolube ™ (wt %) |
|---|---|---|---|
| E | Balance | 0.75 | 0.0 |
| F | Balance | 0.0 | 0.75 |

Examples 1 to 19

Evaluation of Green Properties

The powder compositions shown in Tables 1 and 2 were compacted in a compaction device at various temperatures and pressures to form test bars. Some of the test bars were subsequently heat treated in air or nitrogen at various temperatures. The test bars were then evaluated green density, green strength, and green expansion. The test methods used for determining green density and green strength were as follows:

| Property | Test Method |
|---|---|
| Green Density | ASTM B331-95 |
| Green Strength | ASTM B312-96 |

Green Expansion was determined according to the following equation:

$$\text{Green Expansion}(\%) = \frac{100[(\text{green bar length}) - (\text{die length})]}{\text{die length}}$$

The results are reported below in Table 3.

TABLE 3

Green Properties of Compacted Metal-Based Powder Compositions

| Example | Material from Table | Comp. Pressure (Mpa) | Comp. Temp. (° C.) | Cure Temp. (° C.) | Green Density (g/cm$^3$) | Green Strength (psi) | % Green Exp. |
|---|---|---|---|---|---|---|---|
| 1 | A | 410 | ambient | 274 | 6.57 | 18,663 | — |
| 2 | A | 685 | ambient | 274 | 7.09 | 27,713 | — |
| 3 | A | 685 | ambient | None | 7.18 | — | — |
| 4 | B | 685 | ambient | None | 7.15 | 4050 | 0.33 |
| 5 | B | 685 | 65 | None | 7.20 | 3600 | 0.43 |
| 6 | B | 685 | ambient | 150 | 7.14 | 7200 | 0.38 |
| 7 | B | 685 | ambient | 315 | 7.06 | 13,350 | 0.64 |
| 8 | B | 685 | 65 | 315 | 7.08 | 14,650 | 0.72 |
| 9 | C | 685 | ambient | None | 7.12 | 3559 | 0.26 |
| 10 | C | 685 | ambient | 150 | 7.10 | 6336 | 0.37 |
| 11 | C | 685 | ambient | 204 | 7.08 | 18,100 | 0.41 |
| 12 | C | 685 | ambient | 260 | 7.06 | 19,500 | 0.47 |
| 13 | D | 685 | ambient | None | 7.20 | 2200 | 0.27 |
| 14 | D | 685 | ambient | 315 | 7.16 | 5900 | 0.39 |
| 15 | E | 685 | ambient | None | 7.17 | 4250 | 0.34 |
| 16 | E | 685 | ambient | 150 | 7.17 | 10,850 | 0.35 |
| 17 | E | 685 | ambient | 315 | 7.12 | 13,475 | 0.44 |
| 18 | F | 685 | ambient | None | 7.22 | 2550 | 0.25 |
| 19 | F | 685 | ambient | 315 | 7.17 | 2250 | 0.28 |

The above data demonstrates that acceptable green properties can be obtained when compacting metal-base powder compositions containing a thermoplastic material in accordance wit the method of the present invention in comparison to compacting at temperatures above the glass transition temperature of the thermoplastic material. Compositions A, B, C, and E (containing ULTEM® and/or Orgasol™) showed particularly good green strengths when compacted at ambient temperatures and subsequently heat treated.

Examples 20 to 33

Evaluation of Magnetic Properties

The powder compositions shown in Tables 1 and 2 were compacted at 685 MPa in a compaction device at various temperatures to form magnetic core components. Some of the magnetic core components were subsequently heat treated in air or nitrogen at various temperatures. The magnetic core components formed were evaluated for the following properties: density, maximum permeability, coercive force, and magnetic saturation at 80 Oersteds under DC operating conditions. The results are summarized in Table 4 below.

TABLE 4

Magnetic Properties of Compacted Metal-Based Powder Compositions

| Example | Material from Table | Comp. Temp. (° C.) | Cure Temp. (° C.) | Green Density (g/cm$^3$) | Max. Perm.[1] | Coercive Force (Oe)[2] | Bs[3] (kGauss) |
|---|---|---|---|---|---|---|---|
| 20 | B | ambient | none | 7.14 | 195 | 4.78 | 10.08 |
| 21 | B | 65 | none | 7.18 | 211 | 4.79 | 10.55 |
| 22 | B | ambient | 150 | 7.15 | 175 | 4.62 | 9.80 |
| 23 | B | ambient | 315 | 7.09 | 150 | 4.31 | 8.87 |
| 24 | B | 65 | 315 | 7.08 | 150 | 4.39 | 9.03 |
| 25 | D | ambient | none | 7.18 | 205 | 4.85 | 10.44 |
| 26 | D | ambient | 315 | 7.15 | 205 | 4.47 | 10.50 |
| 27 | D | 65 | 315 | 7.17 | 230 | 4.40 | 10.99 |
| 28 | E | ambient | none | 7.16 | 225 | 4.94 | 10.80 |
| 29 | E | ambient | 150 | 7.17 | 230 | 4.96 | 11.04 |
| 30 | E | ambient | 315 | 7.12 | 230 | 4.60 | 10.95 |
| 31 | E | 65 | 315 | 7.14 | 240 | 4.48 | 11.30 |
| 32 | F | ambient | none | 7.20 | 300 | 5.01 | 11.80 |
| 33 | F | ambient | 315 | 7.18 | 315 | 4.61 | 12.03 |
| 39 | F | 65 | 315 | 7.22 | 388 | 4.52 | 12.81 |

[1]Max. Per. is maximum permeability
[2]Oe is Oersteds.
[3]Bs is magnetic saturation at 80 Oersteds.

The data in Table 4 above shows that acceptable magnetic properties can be obtained from magnetic core components formed by compaction of metal-based powder compositions in accordance with the method of the present invention. Particularly good magnetic properties were obtained from magnetic toroids formed from Composition F (iron powder admixed with Kenolube).

What is claimed is:

1. A method of making a metal based component comprised of the steps:

(a) providing a metallurgical powder composition comprising:

(i) at least about 85 weight percent, based on total weight of the metallurgical powder composition, of metal-based powder comprising metal-based particles wherein the metal based particles are substantially free of an iron phosphate layer;

(ii) from about 0.001 to about 15 weight percent, based on total weight of the metallurgical powder composition, of at least one thermoplastic material wherein the thermoplastic material is selected from the group consisting of polycarbonates, polyphenylene ethers, polyetherimides, polyethersulfones, polyamides, polyvinyl acetate, polyvinyl alcohol, alkyl acrylate, alkyl methacrylate, alkyd resins, cellulosic ester resins, cellulosic ether resins, polyurethanes, polyesters, and combinations thereof, and (b) compacting the metallurgical powder composition at a compaction temperature below about 65 degrees Centigrade to form a metal based component.

(c) heat treating the metal based component at a temperature of up to a melting or degradation temperature of the thermoplastic material in order to cure the thermoplastic material.

2. The method of claim 1 wherein the composition is compacted in a die at a temperature up to 55 degrees Centigrade.

3. The method of claim 1 wherein the composition is compacted in a die at a temperature ranging from ambient temperature to about 40 degrees Centigrade.

4. The method of claim 1 wherein the metal based component is heat treated at a temperature from about 90 degrees Centigrade to about 480 degrees Centigrade.

5. The method of claim 1 wherein the thermoplastic material is selected from the group consisting of polyetherimides, oligomers of polyamides, and combinations thereof.

6. The method of claim 5 wherein the composition is compacted in a die at a temperature up to 55 degrees Centigrade.

7. The method of claim 1 wherein the metal based particles have a substantially uniform coating of the thermoplastic material.

8. The method of claim 7 wherein the thermoplastic material is selected from the group consisting of polycarbonates, polyphenylene ethers, polyetherimides, polyethersulfones, polyamides, polymers of ethylene bisstearamide, polyethylene glycol, polypropylene glycol, polyvinyl acetate, polyvinyl alcohol, alkyl acrylate, alkyl methacrylate, alkyd resins, cellulosic ester resins, cellulosic ether resins, polyurethanes, polyesters, polyolefins, and combinations thereof.

9. The method of claim 1 wherein the metallurgical powder composition further comprises a lubricant.

10. The method of claim 9 wherein the thermoplastic material is polyetherimide and the lubricant is oligomers of polyamides, polymers of ethylene bis-stearamide, or combinations thereof.

11. A method of making a metal based component comprised of the steps:

(a) providing a metallurgical powder composition comprising:

(i) at least about 85 weight percent, based on total weight of the metallurgical powder composition, of metal-based powder comprising metal-based particles wherein the metal based particles are substantially free of an iron phosphate layer and have a substantially uniform coating of the thermoplastic material; and (ii) from about 0.001 to about 15 weight percent, based on total weight of the metallurgical powder composition, of at least one thermoplastic material (b) compacting the metallurgical powder composition at a compaction temperature below about 65 degrees Centigrade to form a metal based component.

(c) heat treating the metal based component at a temperature of up to the melting or degradation temperature of the thermoplastic material in order to cure the thermoplastic material.

12. The method of claim 11 wherein the composition is compacted in a die at a temperature up to 55 degrees Centigrade.

13. The method of claim 11 wherein the composition is compacted in a die at a temperature ranging from ambient temperature to about 40 degrees Centigrade.

14. The method of claim 11 wherein the metal based component is heat treated at a temperature from about 90 degrees Centigrade to about 480 degrees Centigrade.

15. The method of claim 11 wherein the thermoplastic material is selected from the group consisting of polycarbonates, polyphenylene ethers, polyetherimides, polyethersulfones, polyamides, polymers of ethylene bisstearamide, polyethylene glycol, polypropylene glycol, polyvinyl acetate, polyvinyl alcohol, alkyl acrylate, alkyl methacrylate, alkyd resins, cellulosic ester resins, cellulosic ether resins, polyurethanes, polyesters, polyolefins, and combinations thereof.

16. The method of claim 11 wherein the thermoplastic material is selected from the group consisting of polyetherimides, oligomers of polyamides, polymers of ethylene bisstearamide, and combinations thereof.

17. The method of claim 15 wherein the composition is compacted in a die at a temperature up to 55 degrees Centigrade.

18. The method of claim 15 wherein the composition is compacted in a die at a temperature ranging from ambient temperature to about 40 degrees Centigrade.

19. The method of claim 11 wherein the metallurgical powder composition further comprises a lubricant.

20. The method of claim 11 wherein the thermoplastic material is polyetherimide and the lubricant is oligomers of polyamides, polymers of ethylene bis-stearamide, or combinations thereof.

* * * * *